United States Patent [19]

Havlik

[11] 4,280,892

[45] Jul. 28, 1981

[54] PROCESS AND APPARATUS FOR THE SEPARATION OF HYDROCARBONS FROM PETROLEUM BEARING MATERIALS

[76] Inventor: Jaroslav J. Havlik, Cambridge, Canada

[21] Appl. No.: 91,571

[22] Filed: Nov. 5, 1979

Related U.S. Application Data

[63] Continuation-in-part of Ser. No. 974,362, Dec. 29, 1978, abandoned.

[51] Int. Cl.[3] ..... C10B 1/06; C10B 53/06

[52] U.S. Cl. ..... 208/8 R; 208/11 R; 201/8; 201/18; 202/117; 202/137

[58] Field of Search ..... 208/8 R, 11 R; 201/7, 201/8, 18, 33; 202/119, 128, 117, 137

[56] References Cited

U.S. PATENT DOCUMENTS

| | | | |
|---|---|---|---|
| 3,432,397 | 3/1969 | Berg | 208/11 R |
| 3,985,637 | 10/1976 | Storrs | 208/11 R |
| 3,998,703 | 12/1976 | Harrell | 201/32 |
| 4,141,793 | 2/1979 | Aoki et al. | 201/24 |
| 4,187,167 | 2/1980 | Havlik et al. | 201/7 |

*Primary Examiner*—Delbert E. Gantz

*Attorney, Agent, or Firm*—George H. Riches and Associates

[57] ABSTRACT

This invention relates to a method and apparatus for the separation of bitumen crude petroleum from oil bearing solid materials and the collection of all the vapors produced, as multiple fractionated hydrocarbons. In its simplest form, the apparatus consists essentially of a means for breaking up the materials into a corresponding particulate; a destructive distillation chamber, a first thermal cracking zone formed by a pair of spaced apart plates consisting of an upper perforate electrically heatable plate and a imperforate electrically heatable plate, both plates being non-rotatable, a movable uni-directional transporter mounted between the plates with a clearance fit, said transporter having a plurality of adjacent material holding compartments; a mechanism for depositing substantially equal amounts of material from the storage bin successively into each compartment; drive means for actuating the mechanism and the transporter to move the materials through the chamber; means for controlling the temperature of the plates to bring about the destructive distillation of the bitumen crude petroleum, vaporizing means of maintaining the bitumen crude petroleum in vapor form in the chamber and then collecting the various hydrocarbons in condensing distillation units.

17 Claims, 8 Drawing Figures

PROCESS AND APPARATUS FOR THE SEPARATION OF HYDROCARBONS FROM PETROLEUM BEARING MATERIALS

This application is an improvement of pending U.S. patent application Ser. No. 905,233 filed on May 12, 1978 as the joint invention of this applicant and William E. Hodges, and a continuation-in-part of application, Ser. No. 974,362 filed Dec. 29, 1978 by Jaroslav Havlik, now abandoned.

BACKGROUND OF THE INVENTION

A number of methods have heretofore been developed for the separation of bitumen crude petroleum from tar sands and other petroleum bearing solid materials and the recovery of the hydrocarbons produced.

One such process is the one used by Great Canadian Oil Sands Limited which employs hot water steam, caustic solution, and numerous separation and treatment tanks.

OBJECT OF THE INVENTION

The object of this invention is to provide a method and apparatus for the separation of the bitumen crude petroleum of such natural earth substances as the tar sands and the shale rock and other solid oil bearing materials hereinafter collectively referred to herein as "the materials" through the destructive distillation, thermal cracking and the collection of all the vapours so produced as individual multiple fractionated hydrocarbons.

Another object of the invention is to provide a method and apparatus for separating, recovering and collecting individual hydrocarbons from the materials with significantly less expenditure of energy than the methods and apparatus presently known and in use.

Another object of the invention is to provide a method and apparatus which will recover all of the hydrocarbons inherent in such materials.

A still further object of the invention is to provide a process and apparatus which completely eliminates the use of hot water and steam for mixing with the tar sands. Instead, the process and apparatus of the invention provides for the direct recovery of useable gases, paraffins, naphthas, gasolines, light, heavy bunker oils, tar compounds and the like for direct transmission to refinery storage.

OUTLINE OF THE INVENTION

The method of the separation of bitumen crude petroleum from tar sands, shale and the like materials solely employing electrical energy, comprises the following steps:

breaking up the materials to a particulate size approximating the physical dimensions of sand particles and storing same in a storage bin sealed against the admission of the ambient air, said stored materials being heated to a temperature not in excess of 100° F.;

depositing a measured amount of the materials on a moving transporter travelling between and in close proximity to a pair of electrically heated plates mounted in a closed destructive distillation chamber having a material inlet at one end and a discharge outlet at the other, the space between the plates forming a first thermal cracking and distillation zone, said materials being deposited at the inlet end and the tailings being ejected at the discharge outlet under conditions inhibiting the admission of ambient air to the chamber;

heating the plates to a temperature to heat the materials to the thermal cracking temperature to destructively distill the bitumen crude petroleum of the materials and vapourize said petroleum; and then collecting the resultant vapourized hydrocarbons.

A suitable apparatus for carrying out the said method employing destructive distillation to separate the bitumen crude petroleum from tar -and, shale and the like, herein referred to as the solid materials employing solely energy in electric form, comprises of the following: a means for breaking up the material to a particulate size comparable to the physical dimension of the sand particles; a storage bin having means, as required by the ambient temperature, to prewarm the materials therein to a temperature preferably not in excess of 110° F. (43° C.), the storage bin being provided with material entrances and exits to substantially prevent the entrance of the ambient air with the materials being processed; a closed destructive distillation chamber having an oil bearing solid materials inlet, discharge outlet and a vaporized petroleum outlet; a first thermal cracking zone formed by a pair of electrically heatable plates in spaced apart parallel relationship consisting of an upper perforate plate having a material inlet and a lower imperforate plate having a material outlet, said plates defining the said zone; a material transporter mounted for uni-directional movement between said plates, said transporter being divided into a plurality of substantially uniformly sized solid material holding compartments; a conveyor to carry the materials from the storage bin in equal measured amounts to fill each compartment in succession of the transporter, said transporter moving the materials through the first thermal cracking zone at a regulated speed synchronized with the metering mechanism; means for adjusting the rate of speed at which the transporter moves the solid material through the first thermal cracking zone, as required by the content of the bitumen crude petroleum present in the materials; electrical means for thermally energizing the first cracking thermal zone and heating the materials to the desired temperature, as required for destructive distillation of the bitumen crude petroleum; means of controlling the temperature of the first thermal cracking zone; means of maintaining the vapours of the bitumen crude petroleum, as released from the materials through destructive distillation, from the exit apertures of the first thermal cracking zone through to the condenser of the first condensing distillate collection unit; means of causing the bitumen crude petroleum vapour to move as steam in a specific direction from the thermal cracking zone to and into the condensing areas of the first and subsequently each successive condenser of each and every condensing distillation unit and means of ejecting the rendered material referred to herein as "the tailings" remaining after distillation of the bitumen crude petroleum bearing solid materials and means for collecting the tailings after first passing them through water in a tank to provide positive isolation of the ambient atmosphere from the vapours within the apparatus and to provide a means of recovering the residual heat energy present with the particles of sand rock, etc. of the rendered material. When necessary to extend the time during which the solid material are in the closed destructive distillation chamber, additional thermal cracking zones and transporters may be added as hereinafter described.

DESCRIPTION OF THE INVENTION

The following description sets forth one embodiment of the apparatus. It is to be understood that this is by way of illustration only since it will be apparent to those skilled in this field, that modifications in the size of the apparatus, the volume of the materials being deposited on the moving transporter, the temperature of the plates, the electric means for heating the first thermal cracking zone, the speed of travel of material through the descructive distillation chamber can be varied. Consequently it is to be understood that, the description of the apparatus in this disclosure is given for the purpose of illustration and not by way of limitation.

In the drawings:

FIG. 7 being a vertical cross-section through the distillation chamber and FIG. 8 being an exploded view of the primary cracking zones, the views being similar to FIGS. 1 and 2.

Figure 1:
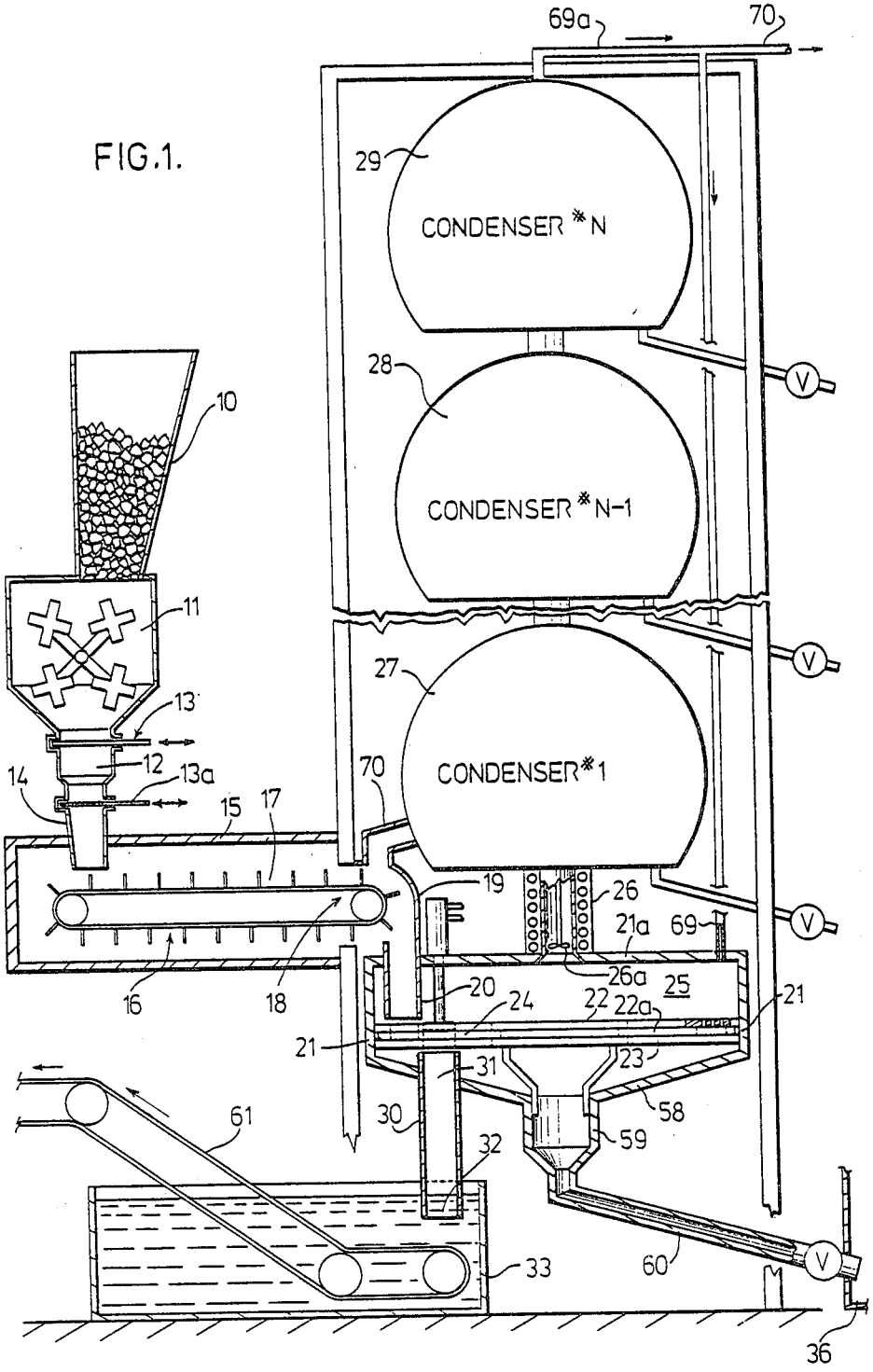
FIG. 1 is a view to illustrate the several parts of the apparatus.

FIG. 1 illustrates diagrammatically the several essential parts of the apparatus having a hopper 10 which holds a supply of the materials and feeds the materials into a chopper 11 wherein the materials are broken up into a particulate size comparable to the physical size of sand particles and delivered to a storage bin 12 therebelow, said storage bin being closed at the top by an upper gate valve 13 and at the bottom by lower gate valve 13*a;* the lower end of the bin having a chute 14 which projects into a conveyor metering compartment 15 in which is mounted a conveyor 16 which has its surface divided into a plurality of material metering pockets 17 which are sized to deliver the same volume of material on demand; the conveyor has its discharge end 18 projecting into a second material delivery chute 19 which has its discharge outlet 20 located at the entrance of a distillation chamber 21 defined by the distillation chamber encasement 21*a.* A first thermal cracking zone 22*a* is formed within the distillation chamber 21 between a pair of fixed and spaced apart electrically heatable plates consisting of a perforated electrically heatable upper plate 22, a lower imperforate plate 23 respectively between which is mounted, with a clearance fit, a first movable transporter 24 by means of which the material is moved through the first cracking zone; a chamber or enclosed space 25 above the upper plate is maintained substantially at the temperature of the distillation chamber; extending into and communicating with chamber 25 is heated conduit 26, which leads to a plurality of condensers, three of which are shown and numbered 27, 28, 29, and labelled #1, #N-1 and #N respectively; a gas pressure equalizer conduit 69, conducts gas from the condenser 29 returning it to distillation encasement 21*a,* and the first condenser 27 has a discharge conduit 70 for low pressure steam vapour leading from the bottom thereof and connected chute 19; a tailing discharge tube 30 has its inlet end 31 adjacent the underside of the lower plate 23 and discharge end 32 in a tailing tank 33; and collecting condensed hydrocarbons in the chamber 25, said system consisting of a downwardly sloping bottom 58 which drains into discharge pipe into pipe line 60 and thence into collecting tank 36.

Figure 2:
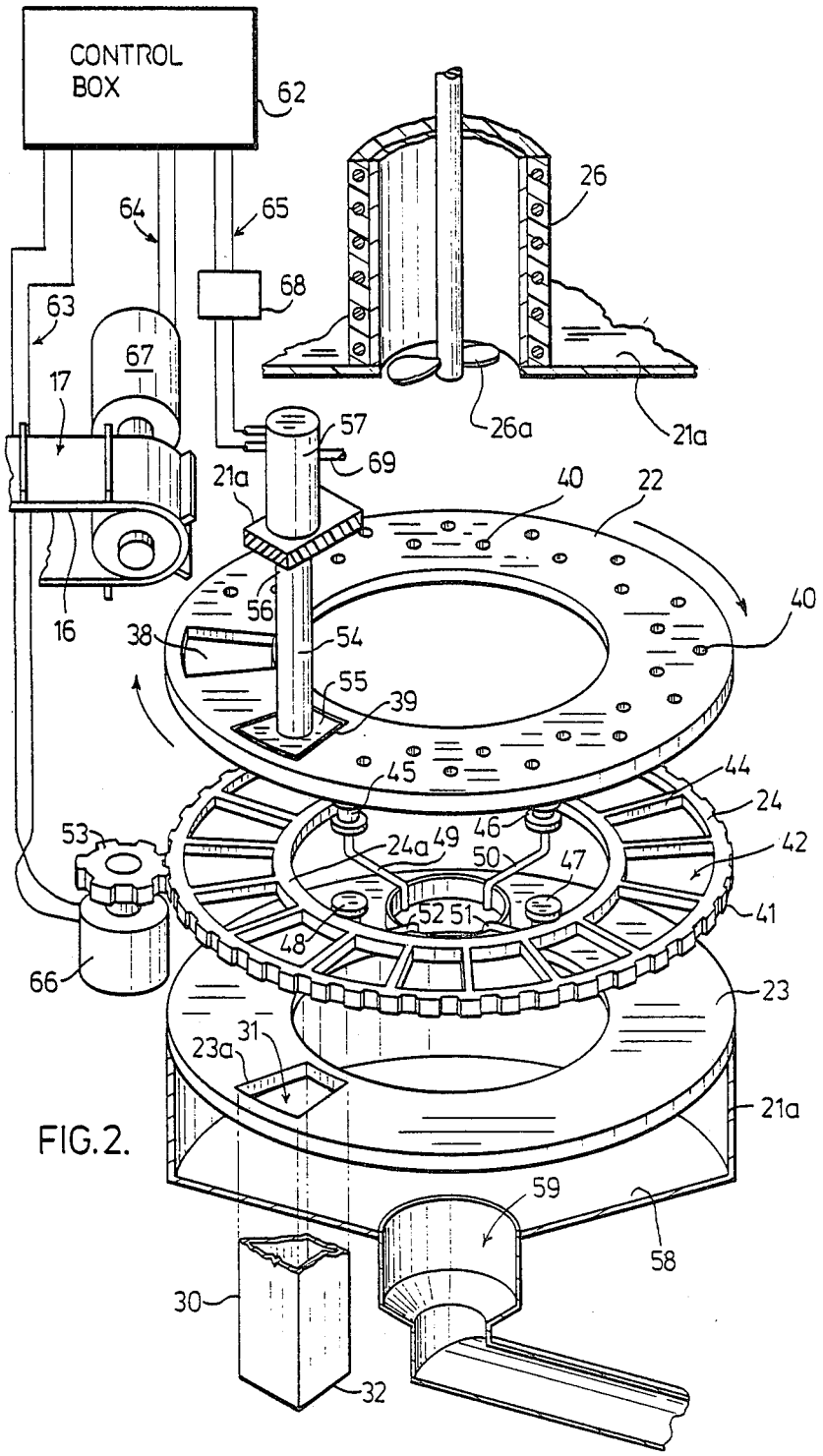
FIG. 2 is an exploded view of the transporter and heatable plates shown in FIG. 1.
Figure 3:
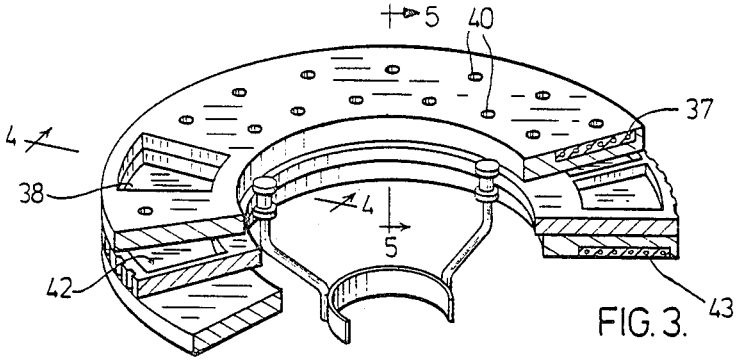
FIG. 3 is a broken perspective view of the heatable plates and transporter in assembled position.
Figure 4:
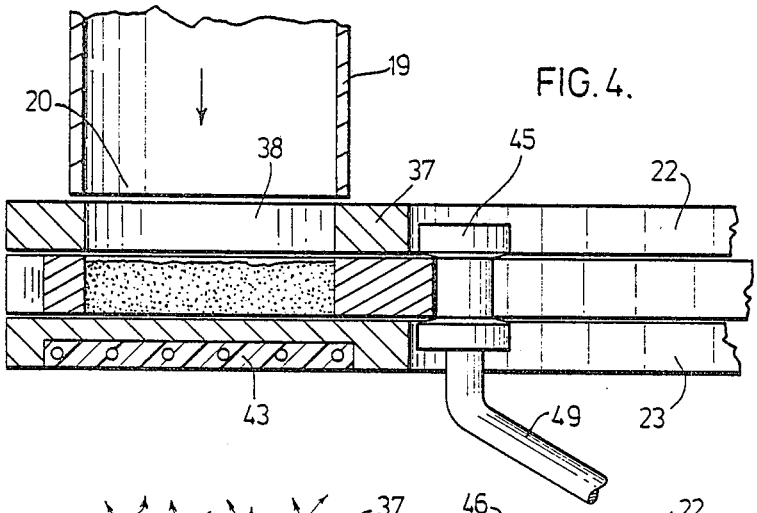
FIG. 4 is a cross-section on the line 4—4 of FIG. 3.
Figure 5:
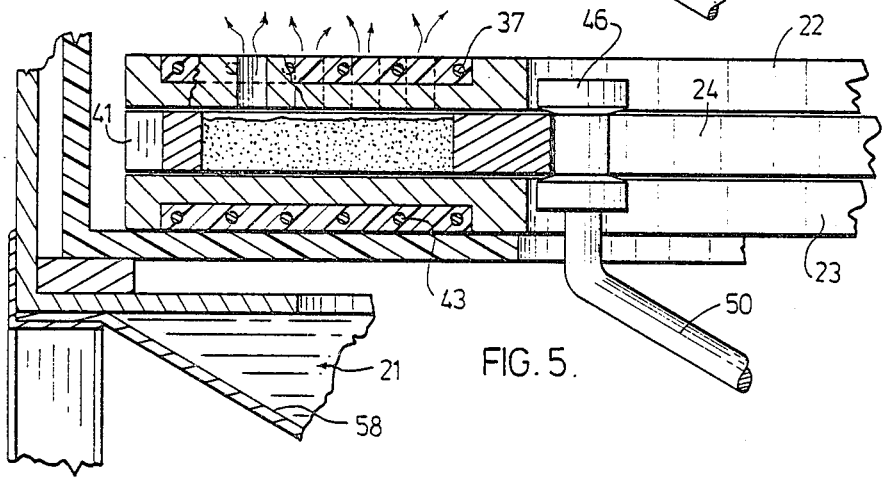
FIG. 5 is a cross-section on the line 5—5 of FIG. 3.
Figure 6:
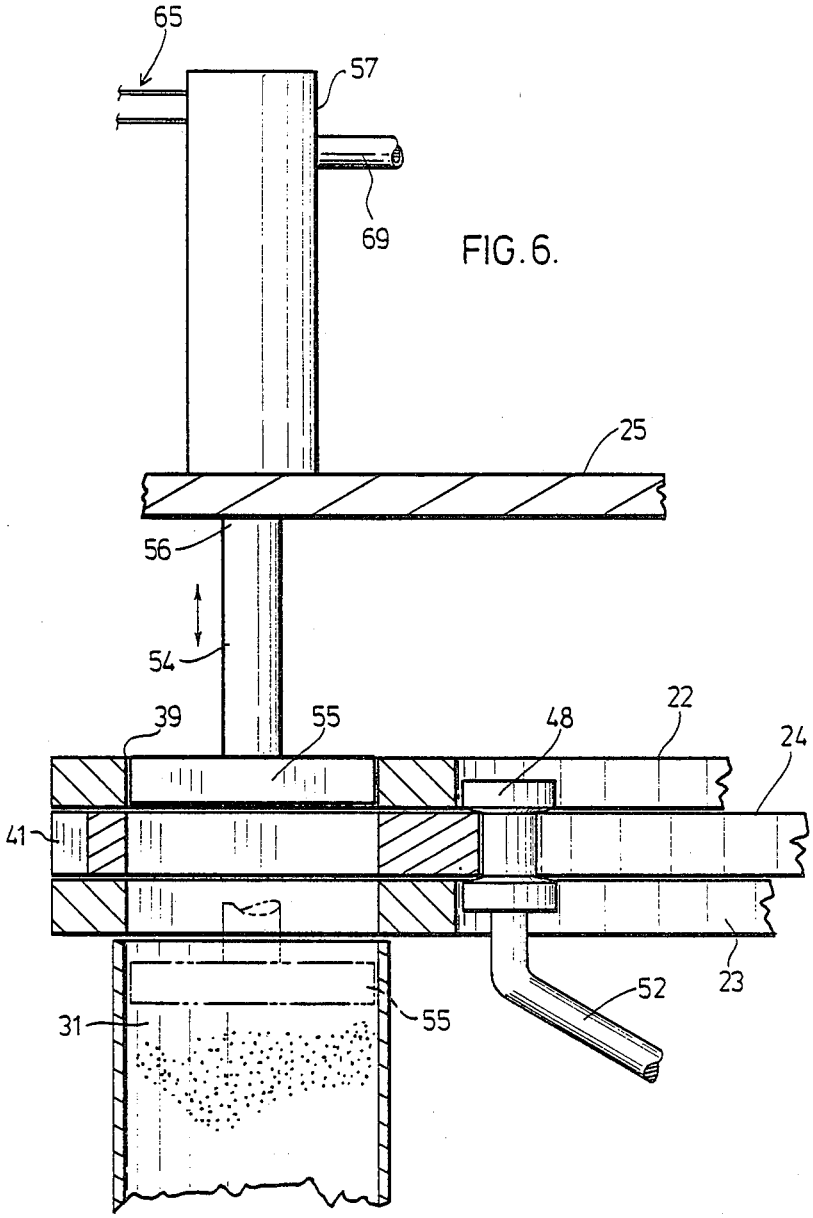
FIG. 6 is a fragmentary cross-section through the plates and transporter at the waste outlet to show a means for ejecting the waste material.

FIGS. 2 and 3 illustrate the structure of the first movable transporter 24, the heatable plates and related parts. The upper plate 22, which is fixed, is annular or ring-shaped and its entire surface is electrically heated by resistance heating elements and/or coils 37. The upper plate 22 is also provided with a material inlet 38 aligned with discharge outlet 20, and opening 39 contiguous to the inlet 38 and the opening 39 is aligned with the inlet end of the tube 30. A plurality of holes 40 through the plate 22 are provided for the passage of vapours into the chamber 25. The plate 22 is supported in the chamber 25 by means of the lower plate 23.

The lower plate 23 is also annular in shape and mounted in a fixed position on the floor of the chamber 25 as shown, below the upper plate 22 and spaced therefrom to receive therebetween, with a clearance fit, the first movable transporter 24 which is mounted for rotation in the direction of the arrow A in FIG. 2. The lower plate is likewise electrically heated by electric resistance elements and/or coils 43. Formed in the plate 23 in alignment with the opening 39 is outlet 23*a* which receives the inlet 31 of the tailing discharge tube 30. The transporter 24 is similar to a cog wheel having an inner hub 24*a* having teeth 41 on the circumference and divided, in the present embodiment, into forty similar material compartments 42 by partitions 44. The compartments have the same volume capacity as the pockets 17. The plate 23 forms the bottom of the compartments 42. The transporter 24 is rotatably supported in position by flanged rollers 45, 46, 47, 48 which engage the hub 24*a,* the rollers being supported by arms 49, 50, 51 and 52 which are connected to the bottom of the chamber and extend upwardly therefrom, as shown. The transporter 24 is driven by cog wheel 53. The outlets 23*a* and 39 are in alignment. The outlets 23*a* and 39, inlet 38, delivery pockets 17 and material compartments 42 are of corresponding size.

Mounted in chamber 25 above the upper plate 22 is the means for ejecting the tailings consisting of an air actuated ejector 54 having its lower end 55 shaped to correspond to the shape of outlets 23*a,* 39 and material compartment 42, the lower end 55 slidably fitting into the opening 39. The upper end 56 of the plunger forms a piston slidably mounted in air cylinder 57 which is connected to a suitable supply of compressed air. The action of the plunger will be described in conjunction with the operation of the apparatus.

The bottom of the distillation chamber 21 has downwardly sloping walls 58 terminating in outlet 59 which leads to a discharge pipe 60.

The bitumen crude petroleum vapours produced are collected as multiple fractionated hydrocarbons in the condensers 27, 28, 29. The propeller 26*a* assists in the movement of the vapours through the condenser systems.

The time control shown in FIG. 2 consists of control panel 62 which controls circuits 63, 64 and 65 leading to motors 66 and 67 that drive the transporter 24 and conveyor 16 respectively and energizes solenoid 68 for opening and closing the air valve controlling the admission of air through conduit 69 to the piston 56 which carries on its end and plunger 55. The control 62 is timed to stop the motor 66 which drives the cog wheel 53 and at the same time energizes the motor 67 to drive the conveyor to deposit material in material compartment 42 and the ejecting mechanism to eject waste material. Then, when that step has been accomplished, the motor 66 is stopped and the ejecting mechanism retracted. The motor 66 is then energized to move the transporter one step to the next filing and ejection position. These actions are repeated successively to move the material through the first cracking zone 22*a*.

The illustrated embodiment is constructed to actuate the mechanism on a stop and go system which at each stop fills pockets 17 and a material compartment 42 with a metered amount of the material and at the same time actuates the ejector 54 to move downwardly into the material compartment which is in registration with outlet 23*a* and eject the tailings contained therein, into the tank 36 which is filled with water. The end 32 of tube 30 is submerged to effectively seal the tube against the admission of ambient air into the chamber 25. The conveyor system 61 removes the tailings from the tank 33. The residual heat in the tank can be recovered.

After a preset time interval, the transporter is moved one step to the next filing and ejection position. The transporter, in the present exemplifications is timed to make one complete rotation in 14 minutes with all the heating elements at a maximum temperature of about 900° F. to 950° C. with the material temperature initially that of the ambient air and caused to increase gradually to 900° F. The temperature of the first cracking zone 22*a* may be varied, having regard to the speed of rotation and the temperature required, to ensure the separation of all of the petroleum from the oil bearing solid materials and the collection of all of the vapours, so produced, in the condensers.

Figure 7:
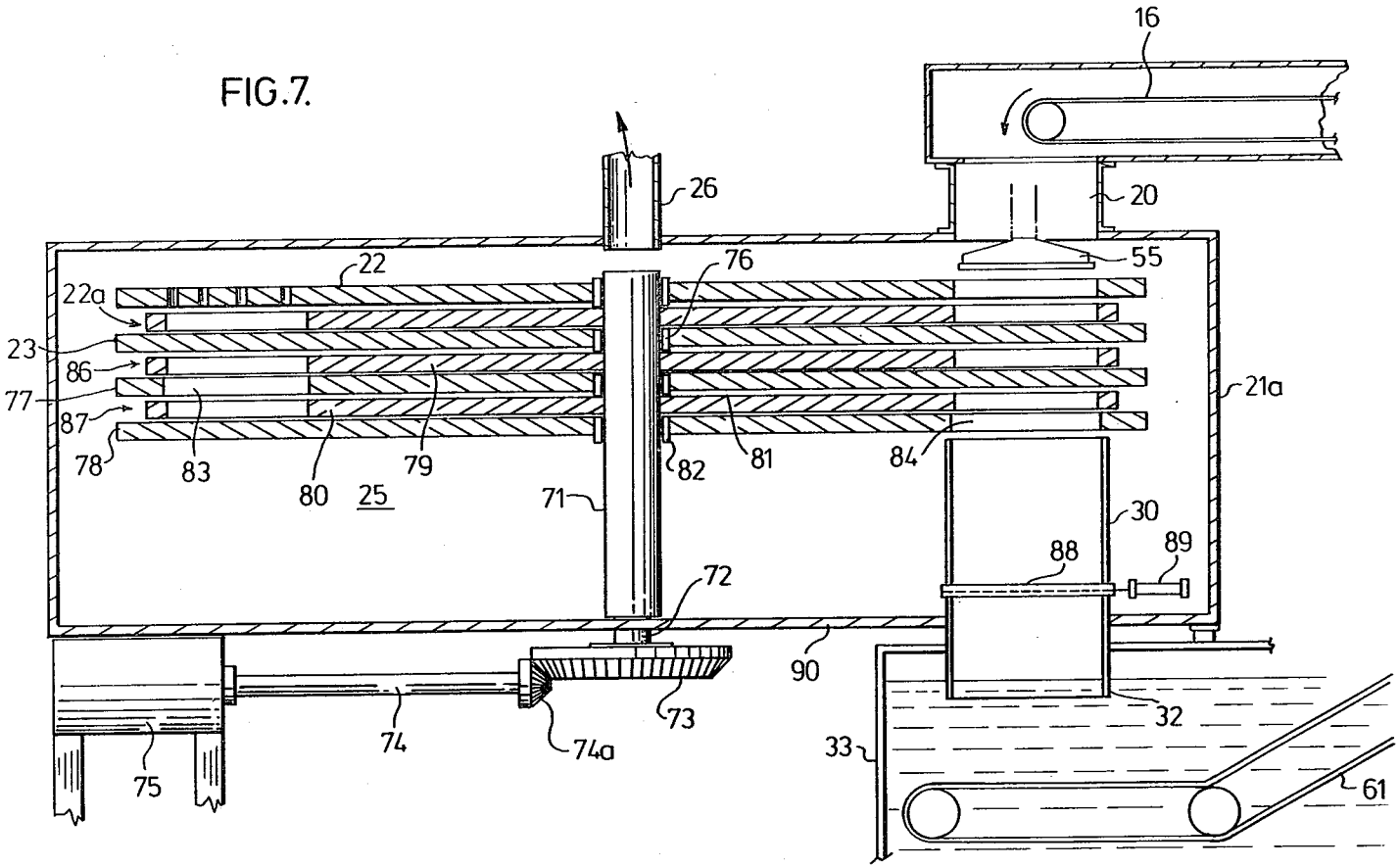
FIGS. 7 and 8 illustrate the modicication wherein additional thermal cracking zones and transporters are added.
Figure 8:
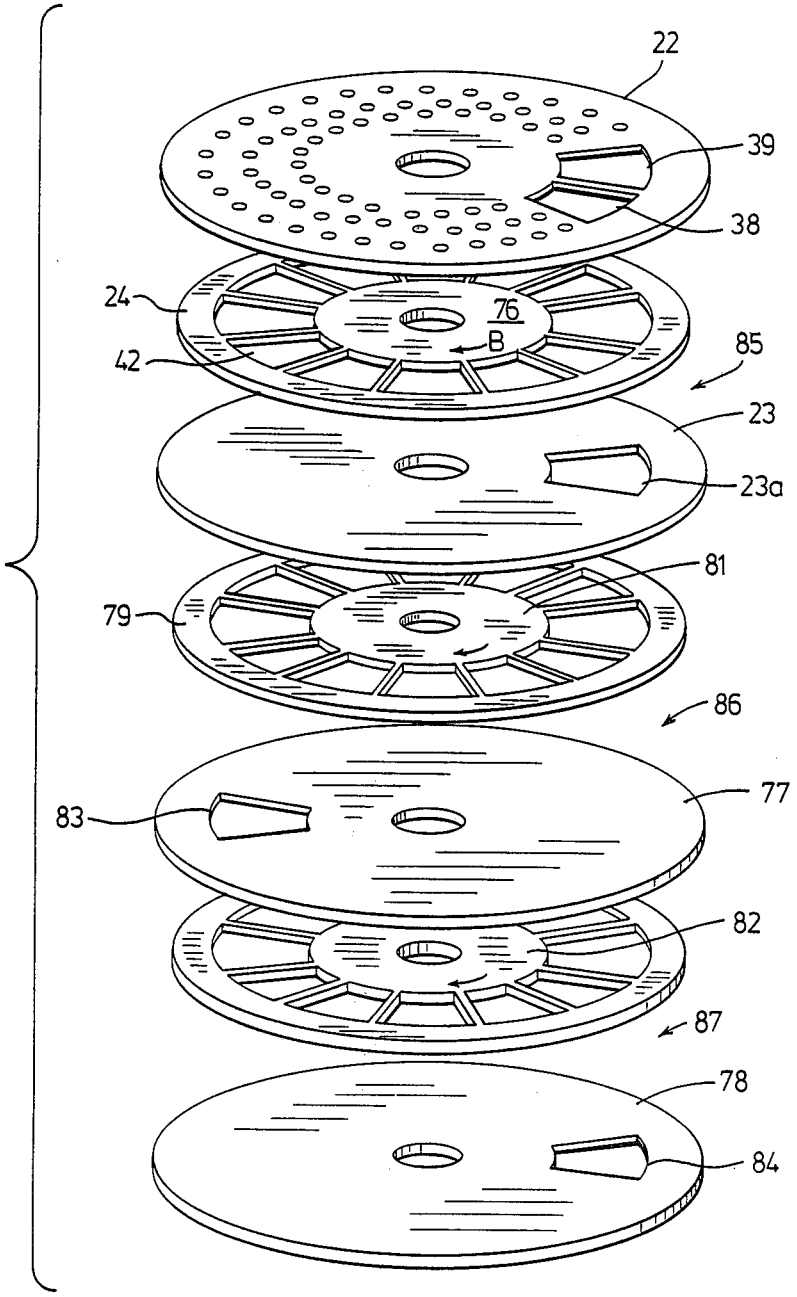

FIGS. 7 and 8 illustrate an alternative construction which adds a plurality of separate thermal cracking zones in communication with each other, in succession, for extending the time that the bitumen crude petroleum is in the thermal cracking zone. The tailings are discharged at the discharge end substantially free of all the bitumen crude petroleum. This alternative structure is useful to improve the recovery, when necessary, of bitumen crude petroleum. The construction illustrated in FIGS. 7 and 8 accomplishes an increased recovery without altering the time period, previously described, to which the material is subjected to direct heating. This reduces the risk of overheating the material. It also operates in the same way as that described with reference to FIGS. 1 through 6.

In the following description of the apparatus shown in FIGS. 7 and 8, the parts of which correspond to the parts illustrated in FIGS. 1 through 6, will bear corresponding numbers.

In FIGS. 7 and 8, the upper plate 22 and lower plate 23 are extended into the centre to be electrically heated from their axis of rotation to the circumference thereof and are supported in spaced apart relationship on a central post 71 which is secured to and rises vertically from the bottom wall 90 of the casing of the distillation chamber. Rotatably mounted in the post 71 is a drive shaft 72 driven, at the previously described speed, by sprocket 73, shaft 74, driving gear 74*a*, and motor 75.

The upper electrically heated plate 22 of FIGS. 7 and 8 is the same as the plate 22 of FIGS. 1 through 6.

The lower electrically heated plate 23 of FIG. 7 is provided with material discharge outlet 23*a* which registers with opening 39. The first transporter 24 is positioned between upper plate 22 and lower plate 23 (FIG. 7) is provided with a central hub 76 rotatably mounted on post 71 and is driven by the drive shaft 72. Mounted below the lower plate 23, in spaced apart relationship, are non-rotating material support plates 77, 78. These plates are heated indirectly by the electrically heated plates 22, 23 but are otherwise similar to plate 23. The spacing between the plate 77, 78 is such as to accommodate therebetween a second transporter 79, and a third transporter 80 between the plates 77, 78. These two additional transporters are similar to transporter 24, and are likewise mounted on drive shaft 72, with a driving connection, by hubs 81, 82 respectively. The plate 77 has a material outlet 83 diametrically opposite the outlet 23*a* and the plate 78 has a material outlet 84 which registers with the waste discharge tube 30. In this illustrated embodiment, the outlet 84 also registeres with outlet 23*a*. All of the transporters rotate in the same direction as indicated by arrow B.

The space between the upper heated plate 22 and the lower heated plate 23, in which the first transporter 24 is housed and rotates, forms the first thermal cracking zone 22*a*. The space between the plates 23 and 77 in which the second transporter 79 is housed and rotates, forms a second thermal cracking zone 86. The space between the plates 77, 78, in which the third transporter is housed and rotates, forms a third thermal cracking zone 87.

The apparatus shown in FIGS. 7 and 8 operates as follows. The material is loaded into the machine in the same manner as has been described with reference to FIGS. 1 through FIG. 6, that is, through material inlet 38 and deposited in one of the material compartments 42 of the first transporter 24. The transporter 24 moves the material at the described speed one complete circuit in the first zone 22*a* which is heated as described. Each time a compartment 42 aligns with material discharge outlet 23*a*, the material is ejected to the second transporter 79 which then moves the material one-half circuit. As each compartment of transporter 79 aligns with material outlet 83 in plate 23, the material contained therein drops, by gravity, into one of the compartments 42 of the third transporter 80 which then moves the material a one-half circuit and bring the material to discharge oulet 84 through which it is discharged, by gravity, into tube 30 and thence to tank 33 as described with reference to FIGS. 1 through 6. If desired, additional plates, in pairs, and transporters similar to plates 77, 78 and transporters 79, 80 may be added below the plate 78 in the same manner. A shutter or trap door 88 has been included in the lower end of the tailings discharge tube 30 a short distance above the water level in the tank 33. The opening and closing of the door 88 is effected by a solenoid mechanism 89 which is timed to open for a sufficient time to permit material to be discharged through material outlet 84 to pass into the tank 33. This inhibits the escape of water vapor from the tank 33 into the distillation system.

It will be apparent to a person skilled in this art that modifications in the method and apparatus may be made without departing from the invention as claimed in the claims hereinafter set forth. For example, instead of heating the first thermal cracking directly as described, the order may be reversed and the lowermost zone may be heated directly by electrically heating the lowermost plates. This would accomplish a more gradual heating of the material through the series of thermal cracking zones.

vapourize said bitumen crude petroleum during the travel of the material through the retort;

LIST OF PARTS

| | | | | | |
|---|---|---|---|---|---|
| 10 | supply hopper | 36 | collecting tank | 66 | motors |
| 11 | chopper | 37 | heating elements and/or coils | 67 | motors |
| 12 | storage bin | 38 | material inlet | 68 | solenoid |
| 13 | upper gate valve | 39 | discharge outlet | 69 | conduit |
| 13a | lower gate valve | 40 | holes | 69a | exit to atmosphere |
| 14 | chute | 41 | teeth | 70 | low pressure discharge conduit |
| 15 | a conveyor compartment | 42 | material compartments | 71 | central post |
| 16 | conveyor | 43 | resistance heating elements and/or coils | 72 | drive shaft |
| 17 | delivery pockets | 44 | partition 44 | 73 | sprocket |
| 18 | discharge end of conveyor | 45 | | 74 | shaft |
| 19 | second chute | 46 | rollers | 74a | driving gear |
| 20 | discharge outlet of the second chute | 47 | rollers | 75 | motor |
| 21 | distillation chamber | 48 | rollers | 76 | hub |
| 21a | distillation chamber encasement | 49 | | 77 | non rotating material support plates |
| 22 | upper plate | 50 | arms | 78 | non rotating material support plates |
| 22a | primary thermal cracking zone | 51 | arms | 79 | second transporter |
| 23 | lower plate | 52 | arms | 80 | third transporter |
| 23a | discharge outlet | 53 | cog wheel | 81 | hubs |
| 24 | movable transporter | 54 | air actuated material ejector | 82 | hubs |
| 24a | inner hub | 55 | lower end of plunger | 83 | material outlet of plate 77 |
| 25 | chamber | 56 | piston | 84 | material outlet plate 78 |
| 26 | outlet conduit | 57 | air cylinder | 86 | second thermal cracking zone |
| 26a | propeller | 58 | downwardly sloping wall | 87 | third thermal cracking zone |
| 27 | condenser #1 | 59 | outlet | 86 | trap door |
| 28 | condenser #N-1 | 60 | discharge pipe | 89 | solenoid mechanism |
| 29 | condenser #N | 61 | conveyor | 90 | bottom wall |
| 30 | tailing discharge tube | 62 | control | | |
| 31 | inlet end | 63 | electric circuits | | |
| 32 | discharge end | 64 | electric circuits | | |
| 33 | tailing tank | 65 | electric circuits | | |

What I claim is:

1. An apparatus for the separation of bitumen crude petroleum from tar sands, and other oil bearing solid materials through destructive distillation and thermal cracking; and the collection of the vapours so produced as multiple fractionated hydrocarbons, said apparatus having means for breaking up the materials into a particulate condition;

(i) a closed destructive distillation chamber;

(ii) means housed in the chamber for heating the oil bearing solid materials to vapourize the bitumen crude petroleum and for transporting all the materials through the chamber, said means comprising:

(iii) an upper perforated electrically heatable plate and a lower imperforate electrically heatable plate, said plates being arranged in fixed spaced apart relationship, said upper plate having an oil bearing materials inlet and the lower plate having a tailings discharge outlet for the discharge of tailings therethrough;

(iv) a material transporter mounted for uni-directional movement with a clearance fit between said plates, said transporter being divided into a plurality of uniformly sized material holding compartments; the said plates forming the top and bottom of the said compartment and the space between the plates constituting a retort;

(v) means for depositing at the inlet end of the chamber, in each compartment in turn, a measured amount of the material during travel of the transporter as it passes the material inlet;

(vi) drive means for moving said transporter in a direction to move the material at a regulated speed of travel through the retort from the material inlet to the discharge outlet, said drive means being synchronized with the depositing means;

(vii) means for controlling the temperature of the plates to heat the material in the compartments to (viii) collecting means for recovering vapourized hydrocarbons in a liquified condition; and (ix) means for ejecting, tailings from each compartment in turn as each compartment registers with the tailings outlet and recovering them under conditions inhibiting the admission of ambient air to the retort.

2. Apparatus according to claim 1 wherein the rate of depositing, and the speed of travel of the transporter are synchronized, and the temperature of the plates is regulated to destructively distill all of the bitumen crude oil of the material.

3. In an apparatus for the separation of bitumen crude from tar sands, oil shale and other oil bearing solid materials through destructive distillation and thermal cracking and the collecting of the vapours so produced as multiple fractionated hydrocarbons, said apparatus having means for breaking up the materials into a particulate condition;

(i) a destructive distillation means housed in a chamber for heating the bitumen crude oil of the material and means for transporting the materials through the chamber, said means comprising;

(ii) upper and lower stationary, electrically heatable annular plates in spaced apart relationship, said upper plate having an inlet opening for the injection of the materials and a second opening adjacent the inlet for an ejector, the lower plate having an outlet opening registering with the second opening for the ejection of tailings therethrough;

(iii) an annular material transporter rotatably mounted between said plates with a clearance fit, said transporter being divided into a plurality of material holding compartments, said plates forming the top and bottom of the compartments and the space between the plates constituting a retort;

(iv) means for depositing a regulated amount of material in each compartment through the inlet opening under conditions inhibiting the admission of ambient air to the chamber;

(v) drive means for rotating said transporter in a direction to move the material at a regulated speed through the retort from the inlet to the outlet;

(vi) means for controlling the temperature within the chamber to destructively distill the bitumen crude petroleum from the material whereby the hydrocarbons are separated from the material during the travel of the material through the retort;

(vii) means for recovering the vapourized hydrocarbons in a solid, liquid or gaseous condition, and (viii) means for ejecting the tailings from each compartment through the outlet as each compartment, in succession, registers with the outlet opening and recovering the same under conditions inhibiting the admission of air to the chamber.

4. Apparatus according to claim 3 wherein the rate of depositing and the speed of rotation of the transporter are synchronized and the temperature of the plates is regulated to the destructive distillation temperature to vapourize all of the bitumen crude petroleum of the material.

5. Apparatus according to claim 3 wherein the compartments are uniformly sized and contiguous to each other and are open at the top and bottom, the lower plate forming the bottom of the compartments, said lower plate having an outlet forming the tailing outlet communicating with the means for recovering the tailings.

6. A method for the separation of bitumen crude petroleum from tar sands, oil-shale and other oil bearing materials through distillation and thermal cracking and the collection of the vapours so produced as multiple fractionated hydrocarbons, comprising the following steps:

(i) breaking up the materials to a particulate size approximating the physical dimensions of sand particles and storing same in a storage bin sealed against the admission of the ambient air;

(ii) depositing a measured amount of the materials on a rotating transporter divided into a plurality of material holding compartments travelling between and in close proximity to an upper perforate plate and a lower imperforate plate, said upper plate having a material inlet and the lower plate having a waste outlet, said plates forming a retort mounted in a distillation chamber having a material inlet at one end and a waste outlet at the other, said materials being deposited in each compartment through the inlet and the tailings being ejected through the waste outlet under conditions inhibiting the admission of ambient air to the chamber;

(iii) heating the plates by means of electricity to a temperature to heat the materials the retort to the distillation temperature to distill substantially all the bitumen crude petroleum of the materials and vapourize said petroleum; and (iv) collecting the resultant vapourized hydrocarbons, in solid, liquid and gaseous form.

7. An apparatus for the separation of bitumen crude petroleum from tar sands and other oil bearing solid materials through destructive distallation and thermal cracking; and the collection of the vapours so produced as multiple fractionated hydrocarbons, said apparatus having means for breaking up the materials into a particulate condition comprising:

(i) a closed destructive distillation chamber having an oil bearing materials inlet at one end and a tailing discharge outlet at the other end;

(ii) a first thermal cracking zone housed in the chamber for heating the oil bearing solid materials to vapourize the bitumen crude petroleum, said zone being constituted by an upper perforate electrically heatable plate and a lower imperforate electrically heatable plate, said plates being arranged in fixed spaced apart relationship, the upper plate having a material inlet and the lower plate having a tailing outlet;

(iii) a first material transporter mounted for rotation between said plates, said transporter being divided into a plurality of uniformly sized material holding compartments, said upper and lower plates forming the top and bottom of the compartments;

(iv) means at the inlet end of the chamber for depositing, in each compartment in turn, an equal volume of the material during travel of the transporter from the material inlet to the tailings outlet;

(v) drive means for moving said transporter in a direction to move the material at a regulated speed of rotation through the first thermal cracking zone from the material inlet to the discharge outlet, said drive means being synchronized with the depositing means;

(vi) means for controlling the temperature of the plates to heat the material in the compartments to vapourize said bitumen crude petroleum during the travel of the material through the chamber;

(vii) collecting means for recovering vapourized hydrocarbons in a liquified condition; and (viii) means for ejecting the tailings at the tailing discharge end of the transporter and recovering them under conditions inhibiting the admission of ambient air to the chamber.

8. Apparatus according to claim 7 wherein the rate of depositing, and the speed of rotation of the transporter are synchronized, and the temperature of the plates is regulated to destructively distill substantially all of the bitumen crude oil of the material during travel of the material from the material inlet to the tailing outlet.

9. In an apparatus for the separation of bitumen crude from tar sands, oil-shale and other oil bearing solid materials through destructive distillation and thermal cracking and the collection of the vapours so produced as multiple fractionated hydrocarbons, said apparatus having means for breaking up the materials into a particulate condition;

(i) a first thermal cracking zone housed in a chamber for heating the bitumen crude oil of the material and means for transporting the materials through the zone, said first thermal cracking zone and said means comprising;

(ii) upper perforate and lower imperforate stationary, annular plates in spaced apart relationship, each plate having electric heating elements embedded therein for heating the plates, and said upper plate having an inlet opening for the injection of the materials and a second opening adjacent the inlet for an ejector, the lower plate having a tailing outlet registering with the second opening for the ejection of the tailings therethrough;

(iii) an annular material transporter rotatably mounted in the said zone between said plates with a clearance fit, said transporter being divided into a plurality of material holding compartments; the said plates forming the top and bottom of the compartments, and the space between the plates constituting the said zone;

(iv) means for depositing a regulated amount of material in each compartment through the inlet opening under conditions inhibiting the admission of ambient air to the chamber and the compartments;

(v) drive means for rotating said transporter in a direction to move the material at a regulated speed through the said zone from the inlet opening to the tailing outlet;

(vi) means for controlling the temperature of the plates to destructively distill the bitumen crude petroleum from the material whereby the hydrocarbons are vaporized and separated from the material during the travel of the material through said first cracking zone;

(vii) means for recovering the vapourized hydrocarbons in a solid, liquid or gaseous condition, and (viii) means for ejecting the tailings from the compartment at the tailing outlet end and recovering the same under conditions inhibiting the admission of air to the chamber and the first cracking zone.

10. Apparatus according to claim 9 wherein the rate of depositing and the speed of rotation of the transporter are synchronized and the temperature of the plates is regulated to the destructive distillation temperature to vapourize substantially all of the bitumen crude petroleum of the material.

11. A method of the separation of bitumen crude petroleum from tar sands, oil-shale and other oil bearing materials through distillation and thermal cracking and the collection of all vapours so produced as multiple fractionated hydrocarbons, comprising the following steps:

(i) breaking up the materials to a particulate size approximating the physical dimensions of sand particles and storing same in a storage bin sealed against the admission of the ambient air;

(ii) depositing a meansured amount of the materials on a rotary transporter, having material holding compartments, travelling between and in close proximity to a pair of plates the space between the plates forming a first thermal cracking zone having a material inlet in the upper plate and a tailing outlet in the lower plate, said materials being deposited, through the inlet, in said compartments and the tailings being ejected at the tailing outlet under conditions inhibiting the admission of ambient air to the cracking zone;

(iii) heating the plates, by means of electric elements embedded therein, to a temperature to directly heat the materials to a temperature to distill the bitumen crude petroleum of the materials and vapourize said petroleum during the travel of the materials through said zone from the inlet to the outlet; and (iv) collecting the resultant vapourized hydrocarbons, in solid, liquid and gaseous form.

12. An apparatus for the separation of bitumen crude petroleum from tar sands, and other oil bearing solid materials through destructive distallation and thermal cracking; and the collection of the vapours so produced as multiple fractionated hydrocarbons, said apparatus having means for breaking up the materials into a particulate condition;

(i) a closed destructive distillation chamber having an oil bearing materials inlet at one end and a tailing outlet at the other end;

(ii) a plurality of thermal cracking zones housed in the chamber in stacked relationship, for heating the oil bearing solid materials to vapourize the bitumen crude petroleum and means in each zone for transporting the materials through each zone, said zones comprising:

(iii) a first thermal cracking zone for heating the oil bearing solid materials to vapourize the bitumen crude petroleum constituted by a first upper perforated electrically heatable plate and a second lower imperforate electrically heatable plate, said plates being coaxial and arranged in spaced apart fixed relationship and having embedded therein electric heating elements, the first plate having a material inlet and the second plate having a material outlet for delivery of material to a second thermal cracking zone therebelow;

(iv) said second thermal cracking zone being constituted by a pair of plates consisting of the said second imperforate plate and a third imperforate plate arranged in spaced apart coaxial fixed relationship and having a material outlet for delivery of material therethrough from the first zone to a third thermal cracking zone therebelow;

(v) said third thermal cracking zone being constituted by a pair of plates consisting of the third plate and a fourth plate therebelow and arranged in spaced coaxial fixed apart relationship, said fourth plate having a tailing outlet;

(vi) a material transporter mounted in each zone for uni-directional movement between each pair of said plates said transporters being coaxial with said plates, each transporter being divided into a plurality of uniformly sized material holding compartments, adjacent plates forming the top and bottom of the compartments;

(vii) means for depositing at the material inlet of the transporter in the first zone in succession, a measured amount of the material during travel of the transporter from the material inlet to the respective outlet;

(viii) drive means for moving said transporters in a direction to move the material at a regulated speed of rotation through each zone from the material inlet to the tailing outlet;

(ix) means for controlling the temperature of the plates of the first zone to heat the material in the compartments to vapourize said bitumen crude petroleum during the travel of the material through the zones;

(x) collecting means for recovering vapourized hydrocarbons in a liquified condition; and (xi) means for ejecting, at the discharge end of the third transporter, the tailings and recovering them under conditions inhibiting the admission of ambient air to the chamber.

13. Apparatus according to claim 12 wherein the rate of depositing and the speed of rotation of the transporters are synchronized, and the temperature of each zone is regulated to destructively distill all of the bitumen crude oil of the material passing therethrough.

14. Apparatus according to claim 12 wherein the compartments are uniformly sized and contiguous to each other and are open at the top and bottom, the upper plate of each zone forming the top of each compartment and the lower plate of each zone forming the bottom of the respective compartment, the lower plate of the lowermost zone having an outlet forming the tailing outlet communicating with the means for recovering them.

15. An apparatus for the separation of bitumen crude petroleum from tar sands, oil-shale and other oil bearing solid materials which have been broken into a particulate condition through destructive distillation and thermal cracking and the collecting of the vapours so produced as multiple fractionated hydrocarbons, said apparatus comprising:

(i) a destructive distillation chamber;

(ii) a plurality of separate thermal cracking zones housed within the chamber, in stacked coaxial relationship and in communication with each other, each zone consisting of a pair of spaced apart fixed coaxial annular plates and an annular material transporter rotatably mounted between each pair of said plates and coaxial with the plates, each transporter having a plurality of material holding compartments, the uppermost plate having a material inlet and the lowermost plate having a tailing outlet, the plates between the uppermost plate and the lowermost plate each having material passages formed therein for the passage of material to the succeeding zone therebelow;

(iii) means for depositing the material through the material inlet of the uppermost plate into each compartment, in succession, of the transporter in the first zone under conditions inhibiting the admission of ambient air to the chamber;

drive means for rotating said transporters in a direction to move the material at a regulated speed through the zone from the inlet to the outlet;

means for electrically heating the plates forming the uppermost zone and for controlling the temperature to destructively distill the bitumen crude petroleum from the material whereby the hydrocarbons are separated from the material during the travel of the material through the zones;

means for recovering the vapourized hydrocarbons in a solid, liquid or gaseous condition, and means for ejecting the tailings at the outlet of the last zone and recovering the same under conditions inhibiting the admission of air to the chamber.

16. Apparatus according to claim 15 wherein the rate of depositing and the speed of rotation of the transporter are synchronized and the temperature of the electrically heated plates are regulated to the destructive distillation temperature to successively vapourize the bitumen crude petroleum of the material.

17. A method of separation of bitumen crude petroleum from tar sands, oil-shale and other oil bearing materials through distillation and thermal cracking and the collection of substantially all vapours so produced as multiple fractionated hydrocarbons, comprising the following steps:

(i) breaking up the materials to a particulate size approximating the physical dimensions of sand particles and storing same in a storage bin sealed against the admission of the ambient air;

(ii) depositing a measured amount of the materials on a first transporter rotatably mounted between a pair of coaxial fixed plates forming a first thermal cracking zone of a series of communicating thermal cracking zones in stacked relationship and coaxial with each other and housed in a distillation chamber, the first plate of the series having a material inlet and the last plate of the series having a tailing outlet for tailings;

(iii) moving the material, in succession, through each thermal cracking zone of the series;

(iv) heating the first thermal cracking zone by means of electricity to a temperature to heat the materials to a temperature to distill the bitumen crude petroleum of the materials and vapourize said petroleum;

(v) collecting the resultant vapourized hydrocarbons, in solid, liquid and gaseous form;

(vi) and collecting the tailings under conditions inhibiting admission of ambient air to the chamber.

* * * * *